US006425442B1

(12) United States Patent
Latiolais, Jr. et al.

(10) Patent No.: US 6,425,442 B1
(45) Date of Patent: Jul. 30, 2002

(54) ANTI-ROTATION DEVICE FOR USE WITH WELL TOOLS

(75) Inventors: Burney Latiolais, Jr.; Keith T. Lutgring; Samuel P. Hawkins, III, all of Lafayette, LA (US)

(73) Assignee: Frank's International, Inc., Houston, TX (US)

( * ) Notice: Subject to any disclaimer, the term of this patent is extended or adjusted under 35 U.S.C. 154(b) by 0 days.

(21) Appl. No.: 09/631,436

(22) Filed: Aug. 2, 2000

Related U.S. Application Data

(63) Continuation-in-part of application No. 09/368,336, filed on Aug. 3, 1999.

(51) Int. Cl.[7] ..... E21B 17/10; E21B 43/00

(52) U.S. Cl. ..... 166/242.1; 166/241.1; 166/177.4

(58) Field of Search ..... 166/243, 241.1, 166/242.1, 156, 177.7, 177.4, 153, 378

(56) References Cited

U.S. PATENT DOCUMENTS

| | | | | |
|---|---|---|---|---|
| 5,165,474 A | * | 11/1992 | Buisine et al. | |
| 5,246,069 A | * | 9/1993 | Glaser et al. | 166/156 |
| 5,390,736 A | * | 2/1995 | Budde | 166/153 |
| 5,842,517 A | * | 12/1998 | Coone | 166/156 |
| 6,056,053 A | * | 5/2000 | Giroux et al. | 166/155 |

* cited by examiner

*Primary Examiner*—David Bagnell
*Assistant Examiner*—Jennifer R Dougherty
(74) *Attorney, Agent, or Firm*—William E. Johnson, Jr.; The Matthews Firm

(57) ABSTRACT

A drillable, anti-rotation device for limiting the rotation of a downhole tool, such as a cement plug, when drilling out the down hole tool. The drillable, anti-rotation device comprises a drillable sleeve connected within a non-drillable outer tubular member connected within a pipe string. The sleeve has one or more grooves or other indentations, and/or one or more ribs or other protrusions extending inwardly within the interior of the device for gripping or otherwise retarding the rotation of such downhole tool.

34 Claims, 6 Drawing Sheets

ANTI-ROTATION DEVICE FOR USE WITH WELL TOOLS

RELATED APPLICATION

This application is a continuation-in-part of U.S. patent appln. Ser. No. 09/368,336, filed on Aug. 3, 1999.

FIELD OF THE INVENTION

The present invention relates to drilling and completion techniques for downhole wells, and more particularly, but not exclusively, to drillable, anti-rotation devices for use with plugs, float collars and float shoes.

BACKGROUND OF THE INVENTION

The process of drilling subterranean wells to recover oil and gas from reservoirs, consists of boring a hole in the earth down to the petroleum accumulation and installing a pipe liner from the reservoir to the surface. Casing is the protective pipe liner within the wellbore that is cemented in place to prevent collapse of borehole walls and to insure a pressure-tight connection from the surface to the oil and gas reservoir. Casing is typically run into the hole in sections, one section at a time and then is cemented in place. Drilling may then be continued below the casing until the reservoir is reached.

Typically, primary cementing is performed by running in a steel, non-drillable casing string into the wellbore. The casing string commonly has a float collar positioned one or two joints above the float shoe which is at its lower end. Collars and shoes help prevent the back flow of cement during cementing operations. The collars and shoes are usually equipped with a check-valve to prevent cement from returning up the interior of the casing string. Once the casing is run to the desired depth, the casing remains filled with drilling fluid and the cementing operation may begin.

When it is desired to cement the casing in the wellbore, a bottom plug or wiper plug is launched in the casing between the fluid in the well and the cement slurry. This bottom plug commonly has a fluid passage through it which may be sealed by a diaphragm or membrane. The cement is pumped into the casing on top of the bottom plug, forcing the bottom plug down the well, displacing the mud below the plug out of the well, until the bottom plug seats on the float collar, or shoe, or a shoulder. Once the plug reaches the restriction, pumping pressure is increased. This ruptures the seal in the plug's fluid passage and the cement slurry flows through the plug and through the fluid passage of the shoe or collar. Once the required amount of cement is pumped into the well, a top plug is launched into the casing atop the fluid cement column. Typically, the top plug does not have a fluid passage through it. A fluid such as mud or drilling fluid is then pumped into the casing, forcing the top plug and the fluid cement column down the hole and up into the annulus between the casing and the wellbore. It should be recognized that one or more top or bottom plugs may be utilized in cementing operations.

The plugs are usually constructed of a pliable or elastomeric material, such as plastic, wood, rubber, or aluminum, and commonly have a hollow metal or plastic core. The plugs traditionally also have wiper wings which fit snugly within the steel, non-drillable casing string. All of the plugs are constructed of a drillable material. The plugs have three primary purposes: (1) to separate the wet cement slurry from the fluid it is displacing or the fluid which is being used to pump the cement slurry to the desired level; (2) to wipe off the inner surface of the pipe string as the plug travels down the hole; and (3) to aid in preventing back flow of the cement pumped into the casing/hole annulus as the cement sets.

Once the cement has set up and other desired operations have been performed, the plug(s), collar, shoes, and cement may be drilled out. In order to drill the well out, the drill string is run back into the hole until the drill contacts the top plug and the string and drill bit are rotated. In all too many instances, when the drill bit is rotated the plug and set cement within or about it begins to rotate atop of the plug, cement, collar, or shoe on which it rests. This rotation of the plug wastes valuable time and energy in attempting to drill out the well.

Attempts in the past have been made to prevent the rotation of the plug(s) and associated set cement to aid in the drilling of the plugs. One device is disclosed in U.S. Pat. No. 5,842,517 and assigned to Davis-Lynch, Inc. The '517 patent discloses a combination float collar, cement plug, and wiper plug each having inclined J-slots for interconnecting the pieces.

U.S. Pat. No. 5,390,736 assigned to Weatherford/Lamb, Inc., discloses interconnectable plugs and float collars having a "bunt" design. The '736 teaches forming a male "bunt" shaped end and female "bunt" end for fitting the male end.

U.S. Pat. No. 5,165,474 assigned to Dowell Schlumberger, discloses an anti-rotation device for plugs having deformable lips. The '474 teaches a tubular section having a high coefficient of friction, a divergent internal diameter, and a plurality of horizontal annular teeth opposing axial movement of the cement plug within the casing string.

U.S. Pat. No. 5,095,980 assigned to Halliburton Company, discloses a combination non-rotating plug set. The '980 patent teaches a combination of plugs and a collar having molded inserts or teeth. The teeth are adapted to interconnect when the individual tools are in contact to prevent rotation of the interconnected pieces.

U.S. Pat. No. 4,190,111 to Davis discloses an anti-rotation tool to be used in combination with a plug. The '111 teaches a flat plate having protrusions on both faces of the plate. The protrusions are designed to engage, dent and penetrate a cement surface on the plug. The plate is run below the wiper plug.

To date these prior art anti-rotation devices have failed to consistently and effectively prevent the rotation of the plugs when drilling out. In many cases at least one if not all the engaging surfaces fail to engage, allowing rotation of the plugs. In addition, it is not uncommon to fail to pump the plugs in contact with one another, preventing interconnection of the plugs. Further, in deviated or horizontal wells it is difficult, at best, to interconnect the tools to be drilled out, thereby resulting in failure to limit rotation of the plug. Additionally, it is common for the teeth, slots, hooks, protrusions to slip or fail negating the purpose of the devices. Further, the prior art devices require the purchase of interconnecting pieces, such as, a set of plugs and a corresponding shoe or collar from the same vendor, thereby limiting the choice of an operator to select preferred plugs, collars, and shoes.

It would be a benefit therefor, to have an anti-rotation device which is reliable and inexpensive. It would be a further benefit to have an anti-rotation device which does not require interconnection of the plugs to prevent rotation. It would be a still further benefit which does not require interconnection between the plugs and shoe or collar. It would be an additionally benefit to have an anti-rotation device which is adapted for use in deviated and horizontal wells. It would be a still further benefit to have an anti-rotation device which may be used with collars, shoes, and plugs originating from differing sources.

BRIEF DESCRIPTION OF THE INVENTION

The present invention is an anti-rotational device of the type used for limiting the rotation of plugs and tools when being drilled out. The anti-rotational device includes: a drillable, substantially cylindrical sleeve connectable within a substantially undrillable pipe string, in the preferred embodiment, a steel, non-drillable string of cylindrical oil-field casing. As used herein, "substantially cylindrical" is intended to cover a sleeve which not only is truly cylindrical, but also a sleeve which is at least partially tapered from one of its ends to the other. The sleeve has at least one rib or discontinuous sets of ribs or other sets of protrusions or grooves or other sets of indentations formed within the interior of the sleeve. The sleeve is formed to dispose at least one plug therein limiting the rotation of the plug and associated set cement when drilling out.

The drillable sleeve is a tubular member forming a passageway therethrough. The sleeve may be formed of any type of drillable material such as pliable rubbers and plastics, wood, aluminum, brass and the like. Many of these materials are currently used in drillable tools such as the plugs, wipers, float shoes or collars or the like. Formed along the interior surface of the sleeve are protrusions such as ribs. These ribs may be formed substantially along or discontinuously along the longitudinal axis of the sleeve, or they may be formed in a substantially circumferential non horizontal pattern, or at an acute angle with respect to the longitudinal axis of the drillable sleeve. In the substantially longitudinal projection the ribs or other protrusions act as a brake or high frictional engaging force against the rotation of the plugs. In a slanted or helically "threaded" configuration, the ribs or other protrusions can be arranged so as to counteract the downward force and rotation of the drill bit and string and tend to force the plug upwardly against the bit, and counter to the rotation of the bit thereby aiding in the drilling of the plug. Such a configuration can substantially thread the plug or tool down to the bottom of the float collar or shoe to aide in drilling the plugs or other tools out. The rib(s) or other protrusions or grooves may have a substantially semi-circular, pseudo-circular, rectangular, triangular, or other profile which will aide in gripping the plugs and preventing rotation of the plugs or other tools. The formed passageway of the present anti-rotational device may be cylindrical or tapered from top to bottom at a small angle to assist in preventing longitudinal motion of the plug and associated set cement while it is being drilled.

The sleeve may be formed by molding within a piece of material such as collar stock, a pup joint, casing joint or other material. Additionally, the sleeve may be formed so as to be insertable into material available at the well site, such as a joint of steel casing. In this instance the sleeve can be snugly adhered to the interior of the casing, from one end of the sleeve to the other, using commonly known adhesives such as well cement. In other words, the entire length of the sleeve is preferably right up against the interior surface of the casing, other than for any adhesive material between the sleeve and the casing. Additionally, the sleeve may have threads formed on the exterior thereof for threading into a housing or outer member such as casing or collar stock. This second embodiment more readily allows the anti-rotational device be adjusted to conditions and situations which may be encountered on-site.

The sleeve, whether molded or inserted into a member, may be connected directly to a float collar, shoe, or within a joint not directly adjacent to the shoe or collar. Examples of the anti-rotation device are: a pup joint for connecting where desired; an inline centralizer having an anti-rotation device; a float collar having the anti-rotation device formed therefrom or therein; a float shoe having the anti-rotation device formed therefrom or therein; various length pup joints for multiple plugs; and the sleeve anti-rotational device being formed as an insert which for example may be threaded into or adhered in a conduit such as collar stock or a joint of pipe or casing. It should be recognized that the anti-rotation device can be made and altered on-site to accommodate various desired lengths such as for one plug, two plugs, or multiple plug operations. Additionally, the anti-rotation device of the present invention may be used with plugs manufactured by one vendor and shoes and collars manufactured by another vendor.

In an alternative method, the anti-rotation device may be disposed within the casing string well away from a shoe or collar to provide an indication of the location of a plug as it is being pumped down hole. The location can be determined from the spike in pump pressure when the plug encounters and passes through the anti-rotation device.

In use the anti-rotation device is placed in the steel casing string, typically by threading the substantially nondrillable outer member containing the sleeve into the pipe string. The operator may choose whether the anti-rotation device be pre-molded in a carrier or as an insert depending on the location. Additionally, the length of the anti-rotation device may be preselected or adjusted by selecting pups or interconnecting pieces. The inside diameter of the anti-rotation device is selected so that when drilled out, the inside diameter of the non-drillable casing string remains substantially the same as that of the adjacent pipe string. The anti-rotation ribs or protrusions extend inwardly within the interior of the sleeve so as to compress a portion of the wings or lips of the plug. The wings may be deflected approximate their maximum deflection limits which is disclosed in plug vendor's specifications. The invention contemplates using one or more grooves or other indentations instead of using protrusions, and also contemplates the use of grooves or other indentations in combination with protrusions to prevent the cement plug from rotating.

When the plug is launched into the casing string it is forced down hole by a fluid such as drilling mud or cement. When it reaches the anti-rotation device of the present invention the circumferential wings of the plug are deflected by the ribs of the sleeve lodging the plug within the sleeve. When the grooves are used within the anti-rotation device of the present invention, the elastomeric portion or portions of the cement plug are forced into one or more grooves by the weight of the drill bit, which aids in causing the cement plug not to rotate within the device. It is necessary, in particular for the bottom plug, that the force and pressure necessary to lodge the plug into the anti-rotation device is not so great as to rupture the sealed fluid passage way. In addition, if more than one rib is formed along the interior of the sleeve the ribs are spaced at a distance such that the plug's wings substantially form a seal against the interior of the sleeve to limit back flow of fluid and in particular cement slurry.

If it is desired, a second, third or more plugs are run into the hole as is well known in the art and lodged into the anti-rotation device. It is not necessary that each of the plugs interconnect with each other or with the collar or shoe. The lack of necessity for the plugs or plug and collar or shoe to interconnect is especially beneficial in deviated or horizontal wells.

When it is desired to drill out the plugs, collar, shoe, and cement, the drill bit is run into the hole on the drill string. When the top plug is encountered, the bit is rotated traditionally to the right to cut up and destroy the drillable obstructions within the non-drillable casing. As the bit rotates the plugs tend to follow the rotation of the bit, resulting in failure to drill out the plugs or increased time and energy to drill out the plugs. However, contrary to the methods and apparatus which have been known in the prior art, with the anti-rotation device of the present invention the sleeve ribs or other protrusions and/or grooves or other indentations within grip the plug and associated set cement and limit the rotation of the plug allowing it to be drilled out. In a preferred embodiment, the ribs have a semi-circular or quarter-circular profile with the planar side disposed against the direction of rotation of the plug during drill out. This design provides gripping strength to the ribs and lateral strength to withstand the rotational forces. Additional embodiments, such as a triangular profile also provide strength against the rotational force. Additionally, as cement is pumped through the cement plug it sets up in the annulus formed between the deflected portion of the wings and the sleeve ribs, thereby providing additional anti-rotation forces at least against rotation of the cement plug and the wiper plug.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

DESCRIPTION

Figure 1:
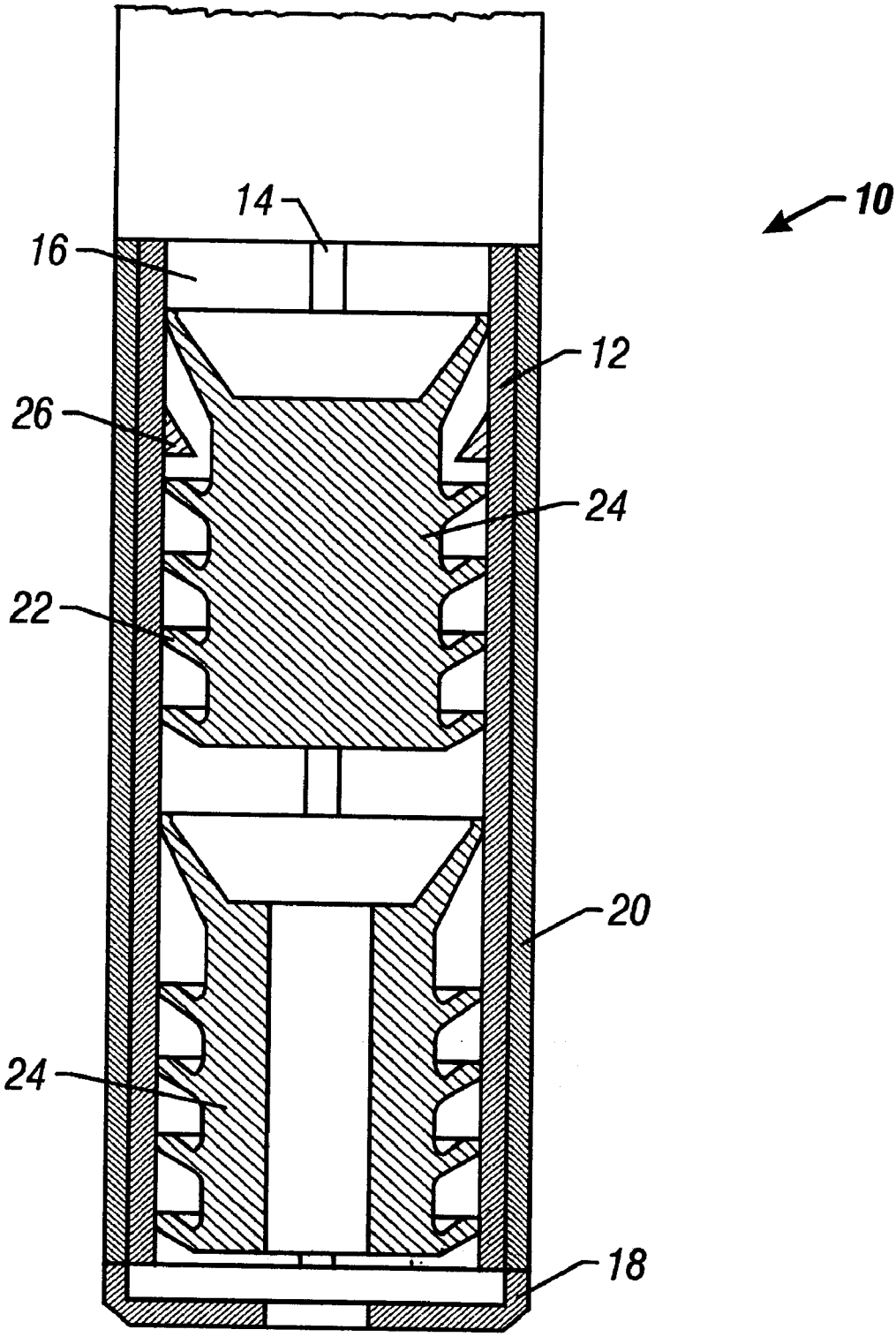
FIG. 1 is a partial, cross-sectional view of the anti-rotation device of the present invention.

FIG. 1 is a partial, cross-sectional view of the anti-rotation device, generally designated by the numeral 10, of the present invention. Device 10 includes a drillable sleeve 12 having ribs 14 extending inwardly from the interior surface 16 of sleeve 12. Sleeve 12 and ribs 14 are made of a drillable material such as, but not limited to, pliable rubbers and plastics, wood, aluminum, and brass.

As shown in FIG. 1, cylindrical sleeve 12 is preferably formed of plastic which is adhered to the interior surface of the steel, non-drillable casing 20. The float shoe 18, also fabricated from a drillable material, is typically threaded into the lower end of the casing 20. Although a casing 20 is illustrated, the casing 20 may in fact be a pup joint, a joint of steel pipe, drill collar stock or any other steel tubular which is non-drillable, for example, manufactured from steel or steel-based alloys.

Sleeve 12 forms at least one rib 14 extending continuously or discontinuously from interior surface 16 so as to deform the wings 22 of wiper plugs 24 so as to lodge wiper plugs 24 within sleeve 12 and to limit the rotation of wiper plugs 24 and associated set cement when drilling out. The number and positioning of rib(s) 14 may vary depending on the inside diameter of the pipe and design considerations. Moreover, while shown generally parallel to a longitudinal axis in FIGS. 1 and 2, ribs 14 may be at an acute angle, as illustrated in FIGS. 6, 9, 12 and 14.

Additionally, anti-rotation device 10 may include a lock down device 26 such as the reducing diameter tabs shown in FIG. 1. Lock down device 26 allows plugs 24 to pass downwardly and resists any downhole back pressure from urging plugs 24 out of sleeve 12 and back up the pipe or casing string.

Figure 2:
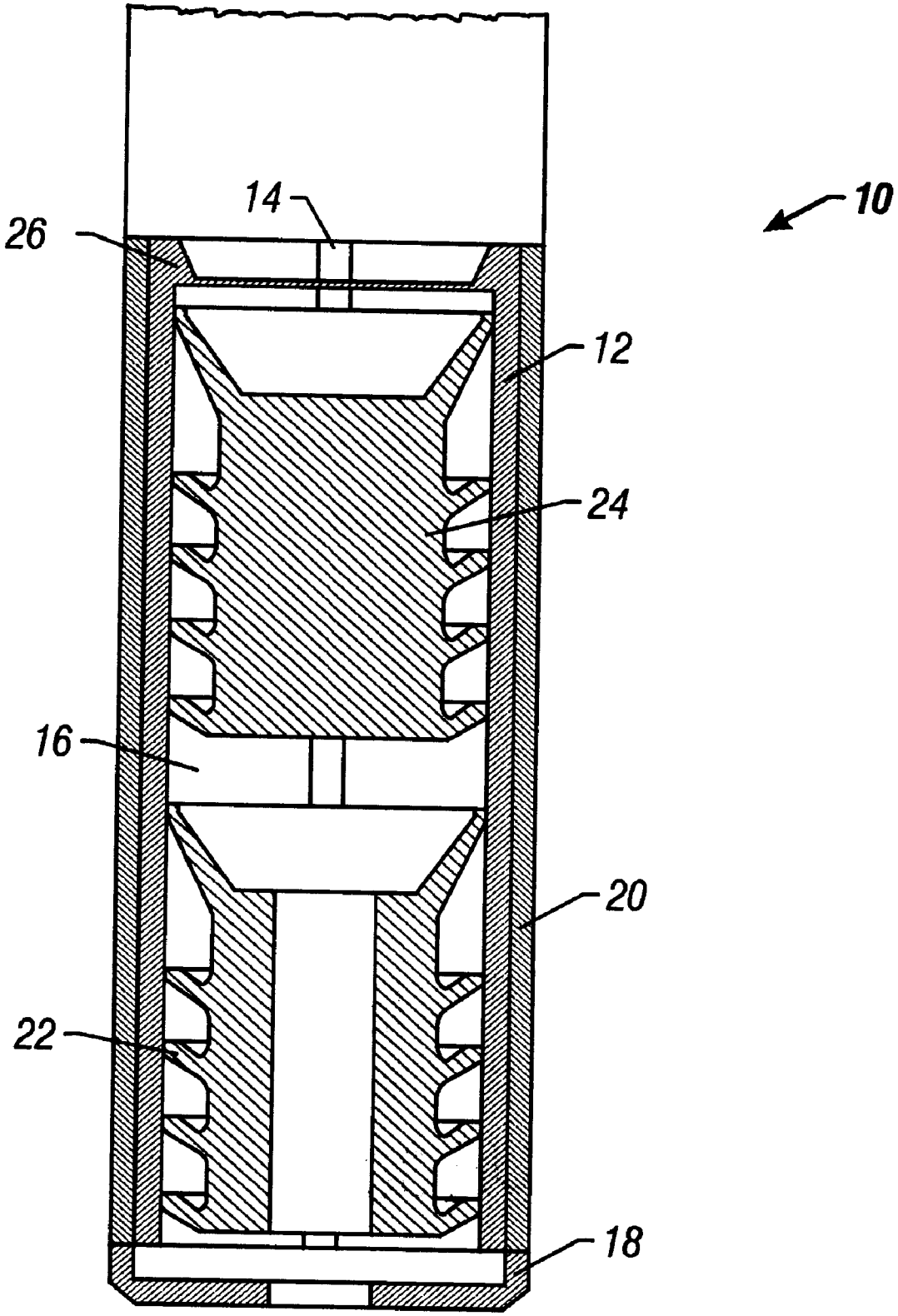
FIG. 2 is a partial, cross-sectional view of another embodiment of the anti-rotation device of the present invention.

FIG. 2 shows another embodiment of anti-rotation device 10 of the present invention, including an additional embodiment of a lock down device 26'. Lock down device 26' of this embodiment comprises a ring having a divergent diameter to allow plugs 24 to pass downhole and preventing any back pressure from moving plugs 24 back up the pipe string. It should be recognized that neither lock down device 26 of FIG. 1 nor lock down device 26' of FIG. 2 is a required feature of device 10. It should further be recognized that lock down device 26' may be separate from sleeve 12 and can be attached within casing 20. Also, it will be understood that rib(s) 14 may be discontinuous in the longitudinal direction. Similarly, the bore 16 of the device may be tapered inwardly top to bottom.

Figure 16:
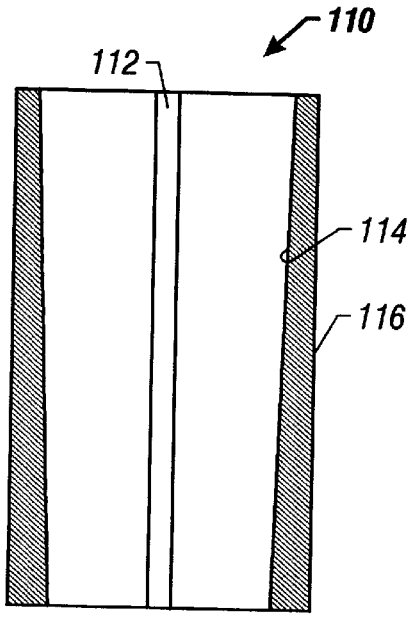
FIG. 16 is an elevated view, in section, of an alternative embodiment of the invention in which the center bore of the cylindrical sleeve is tapered towards a decreasing diameter from its upper end to its lower end.

FIG. 2 shows another embodiment of anti-rotation device 10 of the present invention, including an additional embodiment of a lock down device 26'. Lock down device 26' of this embodiment comprises a ring having a divergent diameter to allow plugs 24 to pass downhole and preventing any back pressure from moving plugs 24 back up the pipe string. It should be recognized that neither lock down device 26 of FIG. 1 nor lock down device 26' of FIG. 2 is a required feature of device 10. It should further be recognized that lock down device 26' may be separate from sleeve 12 and can be attached within casing 20. Also, it will be understood that rib(s) 14 may be discontinuous in the longitudinal direction. Similarly, the bore 16 of the device may be tapered inwardly top to bottom, for example, as illustrated in FIG. 16, the cylindrical sleeve 110 which has a rib 112 or indentation, as the case may be, and a cylinder wall 116 has a tapered inner bore defined by the inner surface 114.

Figure 3:
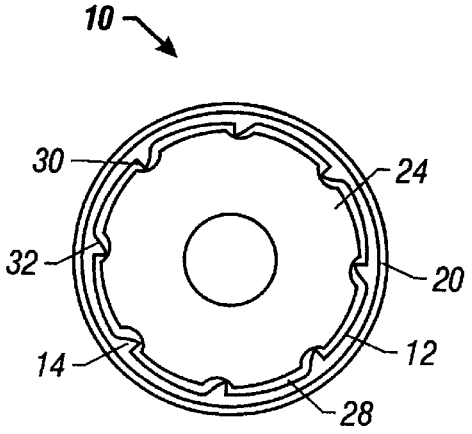
FIG. 3 is a top view of the anti-rotation device of the present invention.

FIG. 3 is a top view of anti-rotation device 10. As shown, sleeve 12 is attached within casing 20, with plugs 24 wedged into sleeve 12 and deformed by ribs 14. A small annulus (unnumbered) may be formed between sleeve 12 and plugs 24. Such annulus usually may be plugged with cement (not shown) which aides in limiting the rotation of plugs 24 when being drilled out.

As shown in FIG. 3, ribs 14 are substantially triangularly shaped having a planar side and an elongated side 32. Preferably, planar side 30 is oriented so as to counter the rotation of the drill bit and the rotation of plugs 24. Typically, drill bits rotate to the right. Elongated side 32 provides strength in limiting the rotation of plugs 24.

Figure 4:
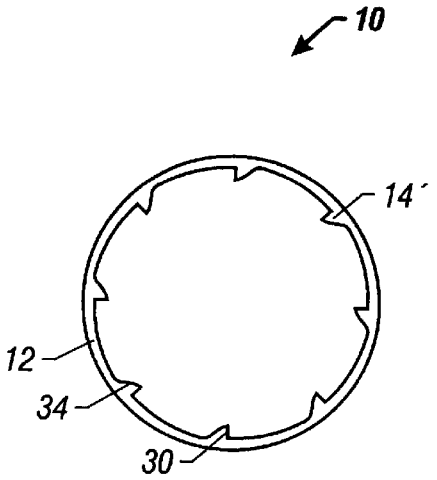
FIG. 4 is a top view of another embodiment of the anti-rotation device of the present invention.

FIG. 4 is a top view of another embodiment of anti-rotation device 10. As shown, sleeve 12 is formed of as a unitary piece to be inserted within a casing 20 (not shown). Additionally, FIG. 4 shows a semi-circular rib 14' as one of many configurations possible for ribs 14. As shown, rib 14' has a planar side 30' oriented against the rotation of plugs 24 (not shown) and a curved side 34.

Figure 5:
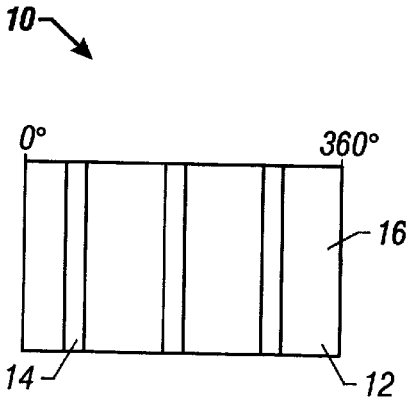
FIG. 5 is a 360 degree view of the interior surface of the anti-rotation device of the present invention.

FIG. 5 is a 360 degree view of interior surface 16 of anti-rotation device 10 of the present invention. As shown in FIG. 5, ribs 14 extend substantially longitudinally along sleeve 12, i.e., substantially along or parallel to the longitudinal axis of the sleeve 12.

Figure 6:
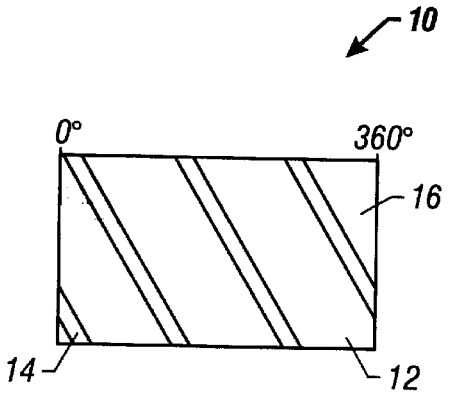
FIG. 6 is a 360 degree view of another embodiment of the interior surface of the anti-rotation device of the present invention.

FIG. 6 is a 360 degree view of another embodiment of the interior surface 16 of anti-rotation device 10 of the present invention. As shown in FIG. 6, ribs 14" are angled across sleeve 12. In this manner ribs may be angled, at an acute angle, so as to tend to rotate the plugs into contact with the drill bit counter to rotation of the bit, aiding in the drilling of the plugs or to rotate the plugs towards into interconnecting contact (see FIG. 1 and 2) and to the bottom of device 10 to aide in the drilling of plugs 24.

Figure 7:
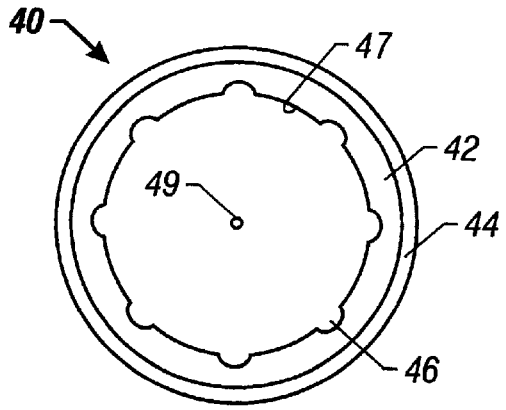
FIG. 7 is a top plan view of an alternative embodiment of the present invention in which grooves or other indentations are used instead of ribs or other protrusions.

FIG. 7 illustrates a top plan view of an anti-rotational device according to the present invention in which the device 40 includes a sleeve 42 positioned within the interior of the non-drillable casing or other tubular 44. It should be appreciated that instead of using the anti-rotation device in accord with FIGS. 1–6 which show ribs or other protrusions, the sleeve 42 in accordance with FIG. 7 has a plurality of indentations 46. In the operation of the device in accord with FIG. 7, as the cement plug is pumped into the interior of the sleeve 42, the elastomeric wings will be forced into the grooves 46 or other indentations and prevent rotation of the cement plug (not shown) as it is pumped into the interior of the apparatus 40.

Figure 8:
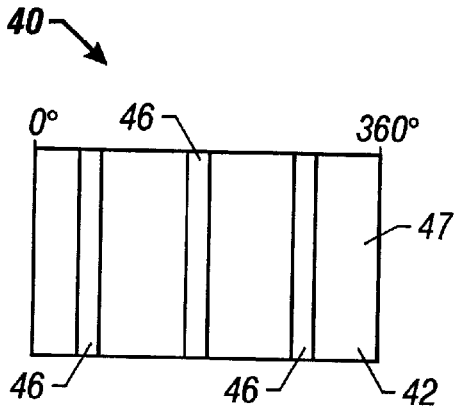
FIG. 8 is a 360° view of the interior surface of the anti-rotation device of the present invention.

FIG. 8 illustrates a 360°, side view of the sleeve 42 of FIG. 7, including the grooves 46 within the interior surface 47 of the sleeve 42. In the embodiment of FIG. 8, it should be appreciated that the grooves 46 are substantially parallel to the longitudinal axis 49 of the sleeve 42 as shown in FIG. 7.

Figure 9:
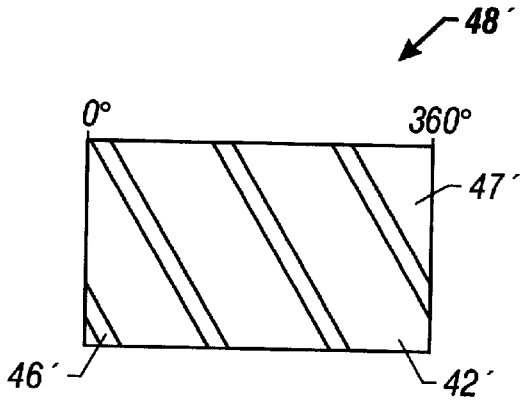
FIG. 9 is a 360° of an alternative embodiment of the interior surface of the anti-rotation device of the present invention.

FIG. 9 illustrates as an alternative embodiment, the grooves 46' being angled at an acute angle from lines parallel to the longitudinal axis 49 of the sleeve 42' along its interior surface 47'.

Figure 10:
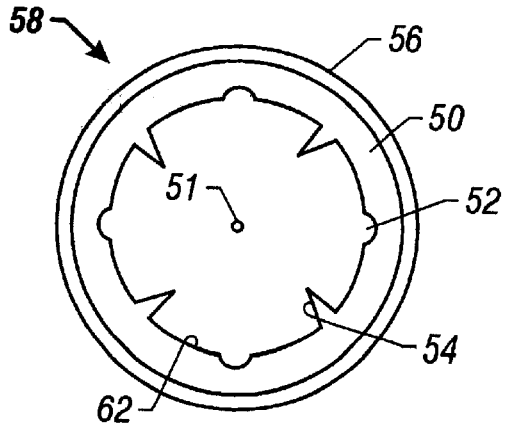
FIG. 10 is a top plan view of an alternative embodiment of the anti-rotation device of the present invention.

FIG. 10 illustrates yet another embodiment of the anti-rotation device in accord with the present invention in which a sleeve 50 includes a plurality of grooves 52 and a plurality of protrusions 54, in which the sleeve 50 is held in place within a non-drillable tubular member 56.

Figure 11:
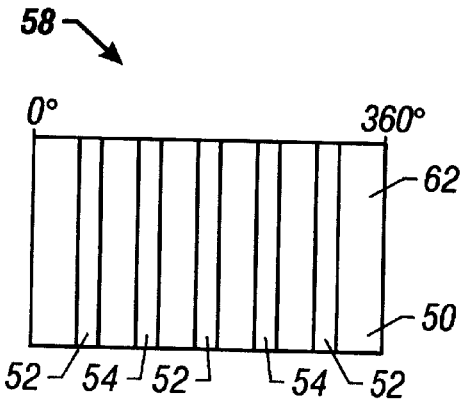
FIG. 11 is a 360°, side view of the anti-rotation device according to FIG. 10.

FIG. 11 illustrates a 360°, side view of the apparatus 58 illustrated in FIG. 10 showing the alternating nature of the grooves 52 and the protrusions, for example ribs 54. Such ribs and protrusions are along the interior surface 62 of the sleeve 50. Such ribs or other protrusions and such grooves run substantially parallel to the longitudinal axis 51 of the sleeve 50 (see FIG. 10).

Figure 12:
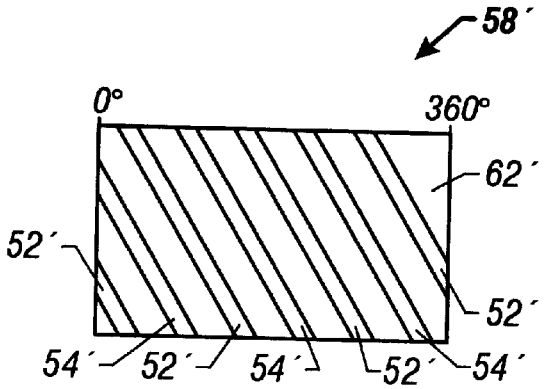
FIG. 12 is also a 360°, side view of the apparatus according to FIG. 10, but having the ribs and grooves at an acute angle with respect to the longitudinal axis of the anti-rotation device according to FIG. 10.

FIG. 12 illustrates a 360°, side view 58' of the anti-rotation device illustrated in FIG. 10, but showing the alternating grooves 52' and ribs or other protrusions 54' as running at an acute angle parallel to the longitudinal axis 51 of the sleeve 58'.

Figure 13:
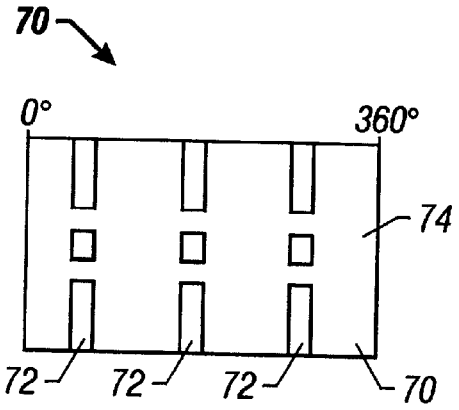
FIG. 13 is a 360°, side view of an alternative embodiment of the anti-rotation device according to the present invention, but having discontinuous protrusions or indentations, as the case may be, in accordance with the present invention.

FIG. 13 illustrates a 360°, side view of a alternative embodiment 70 of the present invention in which the grooves 72 are discontinuous and yet are oriented essentially parallel to the longitudinal axis of the sleeve 70 along the interior surface 74 of the sleeve 70.

Figure 14:
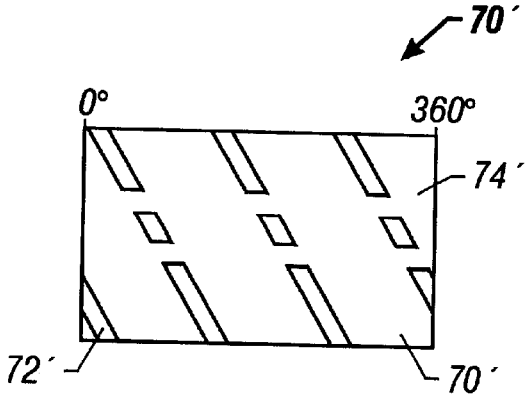
FIG. 14 is also a 360°, side view of an anti-rotation device according to the present invention, but having the protrusions or the indentations, as the case may be, generally angled at an acute angle away from the longitudinal axis of the anti-rotational device according the present invention.

FIG. 14 also illustrates a plurality of discontinuous grooves or other indentations 72' but which are oriented at an acute angle from lines parallel to the longitudinal axis of the sleeve 70' along its interior surface 74'.

Figure 15:
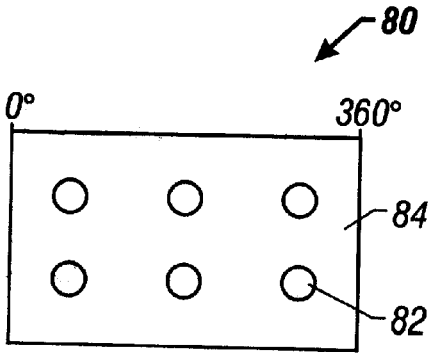
FIG. 15 is a 360°, side view of the anti-rotation device according to the present invention having circular protrusions or indentations, as the case may be, in accordance with the present invention.

FIG. 15 illustrates a 360°, side view of a sleeve 80 having a plurality of semi circular indentations 82 positioned along the interior surface of the sleeve 80. In operation, as the cement plugs are pumped within the interior surface of the sleeves 70, 70' and 80, the elastomeric wings of such cement plugs will be forced into the indentations 72, 72' and 82, respectively, to prevent rotation of such cement plugs when being drilled out.

Figure 17:
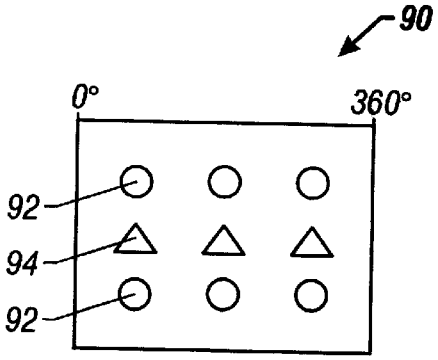
FIG. 17 is a 360° view of the anti-rotation device according to the present invention having both circular and triangular protrusions or indentations, as the case may be.

FIG. 17 illustrates a 360° side view of a cylindrical sleeve 90 having a plurality of circular protrusions or indentations 92, as the case may be, and a plurality of triangular protrusions or indentations 94, as the case may be.

Figure 18:
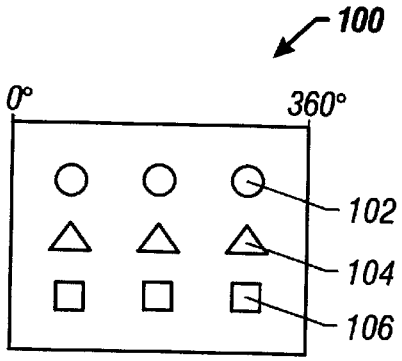
FIG. 18 is a 360° view of the anti-rotation device according to the present invention having both circular, triangular and rectangular protrusions or indentations, as the case may be.

FIG. 18 illustrates a 360° side view of a cylindrical sleeve 100 having a plurality of circular protrusions or indentations 102, as the case may be, a plurality of triangular protrusions or indentations 104, as the case may be, and a plurality of rectangular protrusions or indentations 106, as the case may be.

Figure 19:
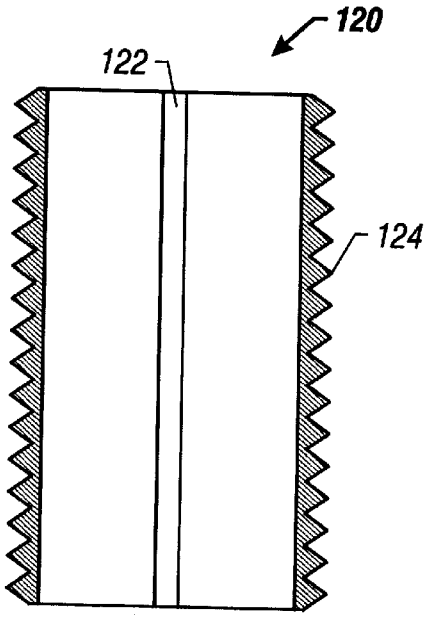
FIG. 19 is an alternative embodiment of the invention showing the sleeve to have threads on its exterior for fixedly connecting the sleeve into the outer tubular member.

FIG. 19 illustrates a sleeve 120 having a rib or indentation 122, as the case may be, and a threaded surface 124 for threadedly connecting into the internal threads of a string of steel casing.

Thus there has been described and illustrated herein various embodiments of a non-rotatable apparatus which can be drilled out and which has, as a primary feature, a surface of either protrusions or indentations, which always presents one or more faces or surfaces which tend to limit the rotation of cement plugs when being drilled out. The longitudinal ribs or other protrusions present a surface which is other than parallel to the rotational force applied by the drill bit. The angled ribs or other protrusions or grooves present a surface which is not perpendicular to the rotational force applied by the drill bit. A surface which is parallel to such rotational bit applied by the drill bit provides no surface at all to limit the rotation of such cement plugs.

It is noted that the embodiments of the anti-rotation device described herein in detail for exemplary purposes is of course subject to many different variations in structure, design, application and methodology. Thus, the ribs or other protrusions may take the form of teeth, buttons, projections, flanges, lips, shoulders, bumps, warts, knobs, studs, spines, or the like, or combinations thereof extending inwardly from the interior surface of the one or more sleeves, and preferable, having at least one surface which is other than perpendicular to the longitudinal axis of the sleeve. Moreover, the terms "groove" and "indentation" are intended to be interpreted in a very broad sense. These terms include the expressions concavity, cavity, hole, pit, depression, basin, bowl, cup, crater, dent, dint, dimple, pit, impression, recess, comb, excavation, and the like. Because many varying and different embodiments may be made within the scope of the inventive concepts herein taught, and because many modifications may be made in the embodiment herein detailed in accordance with the descriptive requirements of the law, it is to be understood that the details herein are to be interpreted as illustrative and not in a limiting sense.

What is claimed is:

1. An anti-rotation device for limiting the rotation of a cement plug disposed therein, wherein said plug has a core and a plurality of wiper wings around said core, said anti-rotational device comprising:

a drillable sleeve fixedly connected within a substantially nondrillable outer tubular member, said sleeve forming a passageway therethrough between first and second open ends; and at least one protrusion extending inwardly from the interior of said sleeve for engaging the wiper wings of said cement plug disposed within said sleeve;

whereby said at least one protrusion has a surface which limits the rotation of said cement plug when said cement plug is acted upon by a rotational force.

2. The anti-rotation device of claim 1, wherein:

said at least one protrusion comprises a rib oriented substantially parallel to the longitudinal axis of said sleeve.

3. The anti-rotation device of claim 1, wherein:

said at least one protrusion comprises a rib oriented at an acute angle with respect to a line parallel to the longitudinal axis of said sleeve.

4. The anti-rotation device of claim 1, wherein:

said at least one protrusion has a pseudo-circular profile.

5. The anti-rotation device of claim 1, wherein:

said at least one protrusion has a triangular profile.

6. The anti-rotation device of claim 1, wherein:

said at least one protrusion has a rectangular profile.

7. An anti-rotation device for limiting the rotation of a cement plug disposed therein, wherein said plug has a core and a plurality of wiper wings around said core, said anti-rotational device comprising:

a drillable sleeve fixedly connected within a substantially nondrillable outer tubular member, said sleeve forming a passageway therethrough between first and second open ends; and a plurality of protrusions extending inwardly from the interior of said sleeve, at least some of said protrusions extending substantially discontinuously along a line parallel to the longitudinal axis of said sleeve;

whereby at least one of said protrusions has at least one surface which engages the wiper wings of said plug and thus limits rotation of said cement plug when said cement plug is being acted upon by a rotational force.

8. The anti-rotation device of claim 7, wherein:

said sleeve is inserted within said outer tubular member and secured therein by an adhesive.

9. The anti-rotation device of claim 7, wherein:

said at least one protrusion has a pseudo-circular profile.

10. The anti-rotation device of claim 7, wherein:

said at least one protrusion has a triangular profile.

11. The anti-rotation device of claim 7, wherein:

said at least one protrusion has a rectangular profile.

12. The anti-rotation device of claim 7, wherein:

said sleeve has threads formed on at least one portion of its exterior surface and is threadably connected within said outer tubular member.

13. An anti-rotation device for limiting the rotation of a cement wiper plug, wherein said plug has a core and a plurality of wiper wings around said core, and associated set cement, during a drill out operation, comprising:

means for catching and holding from pressure from below, said cement plug in a substantially cylindrical shaped sleeve fixedly connected within a substantially non-drillable outer tubular, which extends from an upper open end to a lower open end of said sleeve; and means extending inwardly in said sleeve for engaging the wiper wings of said cement plug and resisting any torsional force applied to said cement plug and associated set cement.

14. The device of claim 13 wherein:

said substantially cylindrical sleeve having an internal diameter which is tapered inwardly from its upper open end toward its lower open end and thus provides assistance in limiting any movement of said downhole tool and associated set cement during a drill out operation.

15. An anti-rotation device fixedly connected within a substantially non-drillable outer tubular, for limiting the rotation of at least one cement wiper plug having a core and a plurality of wiper wings around said core and associated set cement, during a drill out operation, comprising:

means extending inwardly within the interior of said device for engaging the wiper wings of said at least one wiper plug and having at least one surface opposing any torsional force applied to said at least one cement wiper plug and associated set cement.

16. An anti-rotation device for limiting the rotation of a cement plug having a core and a plurality of wiper wings around said core disposed therein, said anti-rotational device comprising:

a drillable sleeve fixedly connected within a substantially nondrillable outer tubular member, said sleeve forming a passageway therethrough between first and second open ends; and at least one indentation formed in the inner surface of, and within the interior of said sleeve for engaging the wiper wings of said cement plug disposed within said sleeve;

whereby said at least one indentation has a surface which limits the rotation of said cement plug when said cement plug is acted upon by a rotational force.

17. The anti-rotation device of claim 16, wherein:

said at least one indentation comprises a groove oriented substantially parallel to the longitudinal axis of said sleeve.

18. The anti-rotation device of claim 16, wherein:

said at least one indentation comprises a groove oriented at an acute angle with respect to a line parallel to the longitudinal axis of said sleeve.

19. The anti-rotation device of claim 16, wherein:

said at least one indentation has a pseudo-circular profile.

20. The anti-rotation device of claim 16, wherein:

said at least one indentation has a triangular profile.

21. The anti-rotation device of claim 16, wherein:

said at least one indentation has a rectangular profile.

22. An anti-rotation device for limiting the rotation of a cement plug, wherein said plug has a core and a plurality of wiper wings around said core, disposed therein, said anti-rotational device comprising:

a drillable sleeve fixedly connected within a substantially nondrillable outer tubular member, said sleeve forming a passageway therethrough between first and second open ends; and a plurality of protrusions extending inwardly from the interior of said sleeve, some of said protrusions extending substantially discontinuously along a line oriented at an acute angle to a line parallel to the longitudinal axis of said sleeve;

whereby at least one of said protrusions has at least one surface which engages said wiper wings and thus limits rotation of said cement plug when said cement plug is being acted upon by a rotational force.

23. The anti-rotation device of claim 22, wherein:

said sleeve is inserted within said outer tubular member and secured therein by an adhesive.

24. The anti-rotation device of claim 23, wherein:

said at least one protrusion has a pseudo-circular profile.

25. The anti-rotation device of claim 24, wherein:

said at least one protrusion has a triangular profile.

26. The anti-rotation device of claim 25, wherein:

said at least one protrusion has a rectangular profile.

27. The anti-rotation device of claim 26, wherein:

said sleeve has threads formed on at least one portion of its exterior surface and is threadably connected within said outer tubular member.

28. An anti-rotation device for limiting the rotation of a plurality of cement plugs, wherein each said plug has a core and a plurality of wiper wings around said core, disposed therein, said anti-rotational device comprising:

a cylindrical, drillable sleeve fixedly engaged within a substantially nondrillable outer tubular member, said sleeve forming a passageway therethrough between first and second open ends; and at least one protrusion extending inwardly from the interior of said sleeve for engaging the wiper wings of said plurality of cement plugs disposed within said sleeve;

whereby said at least one protrusion has a surface which limits the rotation of said cement plugs when said cement plugs are acted upon by a rotational force.

29. The anti-rotation device of claim 28, wherein:

said at least one protrusion comprises a rib oriented substantially parallel to the longitudinal axis of said sleeve.

30. The anti-rotation device of claim 28, wherein:

said at least one protrusion comprises a rib oriented at an acute angle with respect to a line parallel to the longitudinal axis of said sleeve.

31. The anti-rotation device of claim 28, wherein:

said at least one protrusion has a pseudo-circular profile.

32. The anti-rotation device of claim 28, wherein:

said at least one protrusion has a triangular profile.

33. The anti-rotation device of claim 28, wherein:

said at least one protrusion has a rectangular profile.

34. The anti-rotation device of claim 28, wherein:

said plurality of cement plugs comprise first and second cement plugs.

* * * * *